United States Patent [19]

Willis

[11] 4,187,108

[45] Feb. 5, 1980

[54] HEAT DEVELOPABLE MATERIAL AND PROCESS

[75] Inventor: Roland G. Willis, Rochester, N.Y.

[73] Assignee: Eastman Kodak Company, Rochester, N.Y.

[21] Appl. No.: 912,633

[22] Filed: Jun. 5, 1978

Related U.S. Application Data

[63] Continuation-in-part of Ser. No. 766,271, Feb. 7, 1977, abandoned.

[51] Int. Cl.[2] ..... G03C 7/00; G03C 5/30; G03C 1/76; G03C 1/06

[52] U.S. Cl. ..... 430/203; 430/336; 430/353; 430/202; 430/617

[58] Field of Search ..... 96/114.1, 72, 73, 77, 96/84 M, 84 R, 112, 55, 66 T, 60, 76, 53; 250/317, 318; 428/913

[56] References Cited

U.S. PATENT DOCUMENTS

| | | | |
|---|---|---|---|
| 2,041,827 | 5/1936 | Gaspar | 96/98 |
| 2,071,688 | 2/1937 | Gaspar | 96/53 |
| 3,094,417 | 6/1963 | Workman | 96/114.1 |
| 3,152,904 | 10/1964 | Sorensen et al. | 96/76 |
| 3,185,567 | 5/1965 | Rogers | 96/3 |
| 3,257,205 | 6/1966 | Cassiers et al. | 96/76 |
| 3,301,678 | 1/1967 | Humphlett et al. | 96/61 R |
| 3,392,020 | 7/1968 | Yutzy et al. | 96/114.1 |
| 3,531,285 | 9/1970 | Haist et al. | 96/61 R |
| 3,531,286 | 9/1970 | Renfrew | 96/67 |
| 3,592,650 | 7/1971 | DeSelms | 96/48 |
| 3,761,270 | 9/1973 | deMauriac et al. | 96/114.1 |
| 3,769,019 | 10/1973 | Weise et al. | 96/84 R |
| 3,852,093 | 12/1974 | O'Leary | 117/36.8 |
| 3,870,523 | 3/1975 | Ikenoue et al. | 96/114.1 |
| 4,012,260 | 3/1977 | Dickerson et al. | 96/114.1 |
| 4,022,617 | 5/1977 | McGuckin | 96/55 |
| 4,047,956 | 9/1977 | Blake | 96/60 R |
| 4,060,420 | 11/1977 | Merkel et al. | 96/114.1 |
| 4,081,278 | 3/1978 | Dedinas | 96/114.1 |
| 4,088,496 | 5/1978 | Merkel | 96/114.1 |

FOREIGN PATENT DOCUMENTS

| | | | |
|---|---|---|---|
| 790811 | 2/1958 | United Kingdom | 96/76 |
| 930572 | 7/1963 | United Kingdom | 96/114.1 |
| 1096049 | 12/1967 | United Kingdom | 96/76 |
| 1161777 | 8/1969 | United Kingdom | 96/114.1 |

OTHER PUBLICATIONS

Product Licensing Index, vol. 92, Dec. 1971.

Research Disclosure, vol. 140, Dec. 1975, Item No. 14049.

Research Disclosure, vol. 156, Apr. 1977, Item No. 15676.

*Primary Examiner*—Mary F. Kelley

*Attorney, Agent, or Firm*—Richard E. Knapp

[57] ABSTRACT

In a heat developable photographic material and process for providing a dye enhanced silver image, an element comprising a support having thereon in reactive association: (A) at least one heat developable photographic layer comprising (i) photosensitive silver halide, (ii) at least one active silver halide developing agent, (iii) an activating concentration of a development activator precursor, and (iv) a polymeric binder and (B) at least one layer comprising an azoaniline dye that is bleached in the non-image areas of the described element upon development of a latent image in the layer (A) by uniformly heating, can provide an improved image. After imagewise exposure of the described heat developable material, a dye enhanced silver image can be provided by heating the element containing the described combination of layers and materials.

15 Claims, 1 Drawing Figure

HEAT DEVELOPABLE MATERIAL AND PROCESS

This is a continuation-in-part of U.S. Ser. No. 766,271 of R. G. Willis, filed Feb. 7, 1977 now abandoned.

BACKGROUND OF THE INVENTION

1. Field of the Invention

This invention relates to heat developable photographic materials and processes for providing a dye enhanced silver image. In one of its aspects it relates to a heat developable photographic element for providing such a dye enhanced silver image comprising a support having thereon in reactive association certain layers for producing the described dye enhanced image. In another of its aspects it relates to a process for providing such a dye enhanced silver image by merely heating the described heat developable material.

2. Description of the State of the Art

It is well known to provide a silver image in a heat developable material, also known as a photothermographic material, using processing with heat. After imagewise exposure, the resulting latent image in the heat developable material is developed and, in some cases, stabilized, merely by uniformly heating the heat developable material. This heat development can provide a silver image. Such heat developable materials and processes are described, for example, in U.S. Pat. No. 3,301,678 of Humphlett et al, issued Jan. 31, 1967; U.S. Pat. No. 3,152,904 of Sorenson et al, issued Oct. 13, 1964; U.S. Pat. No. 3,392,020 of Yutzy et al, issued July 9, 1968; and British Pat. No. 1,161,777 published Aug. 20, 1969.

Certain photothermographic materials are also known for producing a developed image in color as described, for example, in U.S. Pat. No. 3,531,286 of Renfrew, issued Sept. 29, 1970 and U.S. Pat. No. 3,761,270 of deMauriac and Landholm, issued Sept. 25, 1973. In these color-forming materials, a color-forming coupler is required to provide the color image.

Thermographic materials are also known for providing an image in color. The image is provided by imagewise heating such materials. Such thermographic materials are described, for example, in U.S. Pat. No. 3,094,417 of Workman, issued June 18, 1963 and U.S. Pat. No. 3,592,650 of DeSelms, issued July 13, 1971. These are not useful for photographic processes requiring the photographic speed of photosensitive silver halide in which a latent image is provided by imagewise exposure to light. In addition, colored film materials are known which can be made clear or colorless in image areas when heated thermographically. These can comprise, for example, a mild reducing agent in combination with an amine compound. These thermographic materials are described, for example, in U.S. Pat. No. 3,852,093 of O'Leary, issued Dec. 3, 1974. These thermographic materials also lack the desired photosensitivity of heat developable photographic materials. Use of heat to change an antihalation layer to colorless is described in, for example, U.S. Pat. No. 3,769,019 of Weise and VanDyke Tiers issued Oct. 30, 1973. This described heat bleaching is not employed to provide enhancement of a silver image, but rather is employed for antihalation purposes.

It has been proposed in certain photographic materials to use the oxidized form of certain compounds to react with other components of the material to change the color of the resulting image. For example, in a diffusion transfer photographic material, oxidized developer can be diffused to a contiguous layer. This is described, for example, in U.S. Pat. No. 3,185,567 of Rogers, issued May 25, 1965. This, however, does not relate to heat developable photographic materials.

In a heat developable photographic material it is also known to incorporate a 3-pyrazolidone compound in the material with a silver halide photosensitive emulsion. This compound can be used in a process carried out by contacting a negative layer containing the developing agent before heat development with a positive layer containing a colorless triazolium compound. This is described, for example, in U.S. Pat. No. 3,257,205 of Cassiers et al, issued June 21, 1966. In this process the unreacted developer is used to reduce the colorless material such as a silver salt or a tetrazolium salt to silver metal and dye respectively. This results in the case of the silver salt in a negative scale in silver in the emulsion layer and a positive scale in silver in a receiving layer provided. In the case of the tetrazolium salt, a negative image in silver in the emulsion layer and a positive dye image in the receiver can be obtained. If these layers remain together, they are not useful and must be separated to give both negative and positive images. In this sense, it is not possible to provide for dye enhancement of the silver image in the emulsion layer as described in this patent.

In photographic materials processed in processing solutions or baths, it has been known to provide a dye image which reinforces a silver image formed upon development. This is described, for example, in British Specification No. 1,096,049 published Dec. 20, 1967. This concept, however, has not been used in heat developable photographic materials.

It is known in photographic materials as described, for instance, in U.S. Pat. No. 2,071,688 of Gaspar, issued Feb. 23, 1937 to form a dye over the entire extent of the layer in which it is formed by a reaction wholly independent of the silver image and then to destroy the resulting dye at the points of the silver deposit or at points which are free of the silver deposit. This concept is also described in U.S. Pat. No. 2,041,827 of Gaspar, issued May 26, 1936. It is indicated that a photographic layer containing a silver image can be impregnated with a hydra azo substance and then this hydra azo substance can subsequently be converted into an azo compound. At the point at which the dye is to remain invisible, the azo dye produced can be destroyed locally and this can take place at the points of the silver or the points free of silver in the layer. In each case, however, the image is formed with processing solutions or baths. Also, any dye destruction in the photographic material is by the silver image and not by the unused developer that may be employed.

It is also known to incorporate stabilizer precursors in heat developable photographic materials for processing with heat. Certain sulfur-containing compounds may be heat activated to stabilize an image in a photographic element as described, for example, in U.S. Pat. No. 3,301,678 of Humphlett et al, issued Jan. 31, 1967. The sulfur-containing compound, it is believed, breaks down or "cleaves" at elevated temperatures to form a compound that combines with the silver halide in the unexposed and undeveloped areas of the emulsion. The resulting silver mercaptide is more stable than silver halide to light, atmospheric and ambient conditions. However, no indication is given that such stabilizer precursors can be useful in a material which provides for image enhancement with dye.

In U.S. Pat. No. 4,012,260 of D. G. Dickerson and P. B. Merkel and in *Research Disclosure,* Volume 140, December 1975, Item 14049, published by Industrial Opportunities Ltd., Homewell, Havant, Hampshire, P09 1EF, UK, certain carboxylate compounds are described as activator-stabilizer precursors in heat developable photographic materials. Upon heating, such compounds release an agent that is capable of activating a developer and also release a moiety capable of stabilizing a silver halide image. U.S. Pat. No. 4,060,420 of Merkel and Ling also describes certain activator-stabilizer precursor compounds which are useful in a photographic material which is responsive to heat for processing. The activator-stabilizer precursors are characterized by the fact that they are acid byproducts having reduced toxicity and volatility and other advantages. The described activator-stabilizer precursors have a base portion and an acid portion wherein the acid portion is an α-sulfonylacetate. Especially useful α-sulfonylacetate compounds include bis(2-amino-2-thiazoline)-methylene(sulfonylacetate), N-(2-thiazolino)-N'-(imidazolino)ethylenediamine ethylenebis(sulfonylacetate) and 1,3-bis[2S-(N,N'-ethyleneisothiourea)ethyl-]urea ethylenebis(sulfonylacetate). These activator-stabilizer precursors, however, do not provide an answer to the problem of providing enhanced images by other than formation of further developed silver.

There has been a continuing need to provide improved efficiencies in image formation and use of development products in heat developable photographic materials. There has also been a need to provide improvements in reduction of the concentration of silver needed to provide a desired image in such heat developable materials. Further, there has been a need to provide increased efficiency to enable further use of larger grain silver halide materials to reduce the amount of exposure required to provide a desired image in heat developable photographic materials.

SUMMARY OF THE INVENTION

It has been found according to the invention that these desired properties are provided by a heat developable photographic material for providing a dye enhanced silver image comprising in reactive association: (A) at least one layer comprising (i) photosensitive silver halide, (ii) an active silver halide developing agent, (iii) an activating concentration of an activator precursor, and (iv) a polymeric binder, and (B) at least one layer comprising an azoaniline dye, as described herein, that upon development of a latent image in the layer (A) by uniformly heating is bleached in the non-image areas of the heat developable material. A developed image is provided having improved properties by merely heating the described material to moderately elevated temperatures. While the exact mechanism of image formation is not fully understood, it is believed that upon heating of the material after imagewise exposure, the developing agent is oxidized in the image areas and the unoxidized developer causes the dye in layer B to be bleached resulting in developed silver and dye images in the image areas. The material and process accordingly provide dye enhancement of the silver image and at the same time can provide an additional advantage of halation protection with no change in the imaging chemistry.

DESCRIPTION OF THE DRAWINGS

The FIGURE is a schematic showing of a typical layer arrangement of a photographic element according to the invention with a description of the imaging reaction that is believed to occur.

DETAILED DESCRIPTION OF THE INVENTION

Figure 1:
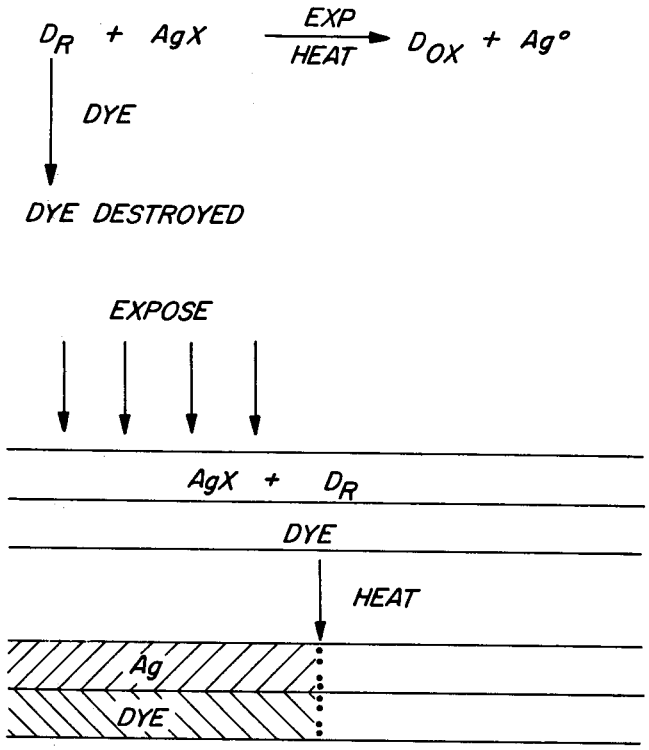

A variety of azoaniline dyes that are bleached in the non-image areas of the described element according to the invention are useful for forming a dye enhanced silver image. While the exact mechanism of image formation with these dyes is not completely understood, it is believed that the azoaniline dyes bearing electron withdrawing groups undergo nucleophilic displacement of the azo function when reacted with suitable nucleophiles such as developer moieties. The process of destroying a dye with a developer moiety has been used to form a negative dye image in a photothermographic material according to the invention by using the described photothermographic element format containing layers (A) and (B). It is believed that upon imagewise exposure and then heating the described element to moderately elevated temperatures, the described developer is oxidized in the image areas and the unoxidized developer destroys the dye resulting in a negative scale in both silver and dye. The process accordingly provides dye enhancement of the silver image and at the same time can provide halation protection with little or no change in the imaging chemistry. While a variety of azoaniline dyes is useful in the described element, composition and process, especially useful azoaniline dyes are represented by the formula:

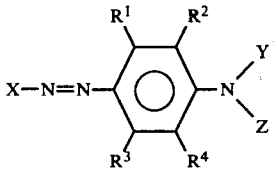

wherein X is a benzene, thiophene, pyrrole, thiazole or furan ring having at least one electron withdrawing group that is a nitro, halo, such as chloro or bromo, trifluoromethyl, acetyl, cyano or methylsulfonyl group, selected to provide a sum of Hammett substituent constants that is greater than +0.7; $R^1$, $R^2$, $R^3$ and $R^4$ are individually selected from hydrogen, alkyl containing 1 to 12 carbon atoms, such as methyl, ethyl, propyl, butyl and pentyl, alkoxy containing 1 to 12 carbon atoms, such as methoxy, ethoxy, and the like, acetyl containing 1 to 12 carbon atoms, such as propionyl, butyryl and pentanoyl, and amido containing 1 to 12 carbon atoms, such as acetamido, propionamido and butyramido; Y and Z are individually selected from hydrogen, alkyl containing 1 to 12 carbon atoms, such as methyl, ethyl, propyl, butyl and pentyl, and cycloalkyl containing 5 to 7 carbon atoms, such as cyclopentyl, cyclohexyl and cycloheptyl. The described Hammett substituent constants include the ortho, meta and para Hammett substituent constants and can be determined by methods known in the art, such as by the method described by D. H. McDaniel and H. C. Brown, *Journal of Organic Chemistry,* 23, pages 420–426 (1958). Useful azoaniline dyes are also exemplified by the compositions described in the following examples.

The concentration of azoaniline dye in layer B as described can vary depending upon such factors as the desired image, processing conditions, particular components of layer A and the like. An optimum azoaniline dye and concentration of such dye can be selected based on the described factors. Typically, a concentration of azoaniline dye as described is within the range of about $10^{-1}$ to about $10^{-2}$ moles of dye per mole of Ag in layer A.

The heat developable photographic materials, as described, contain photosensitive silver halide, preferably due to its high degree of photosensitivity. Useful photographic silver halides include, for example, silver chloride, silver bromide, silver bromoiodide, silver chlorobromoiodide, or mixtures thereof. The photographic silver halide can be coarse or fine grain. The composition containing the photographic silver halide can be prepared by any of the well-known procedures in the photographic art, such as single-jet emulsions, double-jet emulsions, such as Lippman emulsions, ammoniacal emulsions, thiocyanate or thioether ripened emulsions and the like as described in the *Product Licensing Index,* Volume 92, December 1971, publication 9232, published by Industrial Opportunities Ltd., Homewell, Havant, Hampshire, P09 1EF, UK. The term "photographic" is intended to include photosensitive silver halide materials. Surface image silver halide materials can be useful or internal image silver halide materials also as described in the above *Product Licensing Index* publication can be used. If desired, mixtures of surface image and internal image silver halide materials can be useful. Silver halide materials can be regular grain silver halide materials, such as the type described in the above *Product Licensing Index* publication. Negative type silver halide materials are especially useful; however, direct positive silver halide materials can also be used. The heat developable photographic materials according to the invention are particularly useful with silver bromide and silver bromoiodide gelatino emulsions. A range of concentration of photosensitive silver halide can be used in the photographic materials of the invention. Typically, a concentration of photographic silver halide is used that when coated on a support provides a photographic element containing about 2 to about 20 milligrams of silver per square decimeter of support.

The photosensitive silver halide is in reactive association with other components of the described layer A, especially the active silver halide developing agent. The term "active silver halide developing agent" as used herein is intended to mean a silver halide developing agent or developing agent combination that provides desired development of a silver image in described layer A and is sufficiently active to provide the desired bleaching action in layer B also as described. Useful active silver halide developing agents include, for example, polyhydroxybenzenes, such as hydroquinone developing agents, including, for example, hydroquinone, alkyl-substituted hydroquinones, such as tertiary-butylhydroquinone, methylhydroquinone, 2,5-dimethylhydroquinone and 2,6-dimethylhydroquinone; catechols and pyrogallol; chlorohydroquinone or dichlorohydroquinone; alkoxy-substituted hydroquinones, such as methoxyhydroquinone or ethoxyhydroquinone; methyl hydroxy naphthalene; and methyl gallate. If a polyhydroxybenzene developing agent is selected, it is necessary that it be sufficiently active to provide the desired bleaching action in layer B as described. In selecting an optimum polyhydroxybenzene developing agent, it is also often useful to use a combination of an ascorbic acid developing agent, such as ascorbic acid or an ascorbic acid ketal, with the described polyhydroxybenzene developing agent. An example of a useful combination is the combination of hydroquinone with ascorbic acid. Other developing agents which can be used alone or in combination in described layer A include, for instance, aminophenol developing agents, such as p-aminophenol; reductone developing agents, such as anhydrodihydropiperidino hexose reductone. 3-Pyrazolidone developing agents are especially useful in layer A of the described element. Such 3-pyrazolidone developing agents include, for example, 1-phenyl-3-pyrazolidone, 4-methyl-4-hydroxymethyl-1-phenyl-3-pyrazolidone, and other 3-pyrazolidone developing agents described in British Pat. No. 930,572 published July 3, 1963. Combinations of developing agents can be useful if desired.

The term "silver halide developing agent" as used herein is intended to also include developing agent precursors. That is, the term includes compounds, known as precursors, which form a silver halide developing agent, such as upon exposure to suitable energy including light and heat.

A range of concentration of silver halide developing agent or developing agent combination can be useful in the described heat developable photographic materials of the invention. The selection of an optimum concentration of developing agent or developing agent combination will depend upon such factors as the particular developing agent, other components of described layers A and B, processing temperatures, desired image and the like. Typically, a concentration of described developing agent is selected which is within the range of about 0.1 to about 1 mole of silver halide developing agent per mole of silver halide in the heat developable photographic material. When a combination of developing agents is used in the described heat developable material, the total concentration of the combination is typically within the described range.

The described heat developable materials of the invention accordingly contain photosensitive silver halide and a developing agent or developing agent combination. It is believed that upon exposure an image, typically a latent image, is formed in the photosensitive silver halide and that upon heating the element to moderately elevated temperatures, a reaction occurs between the silver halide in the latent image areas and the described silver halide developing agent or developing agent combination. This enables the formation of oxidized and unoxidized developer moieties in the appropriate areas of the element. The term "in reactive association" as employed herein regarding the components of the heat developable material is intended to mean that the location of the photosensitive silver halide and other components of the material are such that will enable this desired reaction.

The reaction between the photosensitive silver halide and the silver halide developing agent is carried out with the aid of an activating concentration of a development activator precursor. The activator precursor is typically a base-release agent or base precursor which upon heating increases the pH of the reaction medium containing the silver halide developing agent and the exposed photosensitive silver halide to provide the desired development reaction. Base-release agents or base precursors which can provide this desired increase in pH are known in the photographic art. Examples of useful activator precursors include guanidinium compounds, quaternary ammonium malonates, particular amino acids, such as 6-aminocaproic acid, heat cleavable hydrazides and oxazolidones as described in U.S. Pat. No. 3,531,285 of Haist, Humphlett and Johnson, issued Sept. 29, 1970. Especially useful activator precursors are compounds which are described as activator-stabilizer precursors and include ionic compounds formed by the reaction of an acid and a base or by ionic exchange using known ionic compounds. As used herein, "acid portion" refers to the anionic part of the compound that originated in the acid and similarly "base portion" refers to the cationic part of the compound that originated in the base. The exact mechanism by which the activator-stabilizer precursors function in the heat developable materials according to the invention is not fully understood. However, it is believed that upon heating the activator stabilizer precursor forms a desired base moiety which provides the desired activation of the developing agent is described. The activator-stabilizer precursor compounds, as described, can be represented by the formula:

$$Q_mA_{w'}$$

wherein Q is a base portion, especially a protonated basic nitrogen containing moiety, and A' is an acid anion that is an alpha-sulfonylacetate or a 2-carboxycarboxamide; and wherein m and w are integers, depending on the nature of the cation and anion sufficient to form a neutral compound. A neutral compound as described is intended to mean a compound that has a net charge of zero. That is, the compound is neutralized because the number of acid groups is balanced by the number of basic groups with none in excess. The term "protonated" herein is intended to mean that one or more hydrogen ions (H+) are bound to an amine moiety forming a positively charged species. Typically, m is 1 to 4 and w is 1 to 2. For example, when Q is a bivalent cation and A' is an univalent anion, m is 1 and w is 2. Particularly useful alpha-sulfonylacetates include, ethylenebis(sulfonylacetate), methylenebis (sulfonylacetate) and phenylsulfonylacetate. Q can be a variety of protonated basic nitrogen-containing moieties as described in U.S. Pat. No. 4,060,420 of Merkel and Ling, for example. Examples of useful activator-stabilizer precursors within this class of compounds include bis(2-amino-2-thiazolinium)methylene bis(sulfonylacetate), and 1,3-bis[2S-(N,N'-ethyleneisothiourea)ethyl]urea ethylenebis(sulfonylacetic acid) represented by the formula:

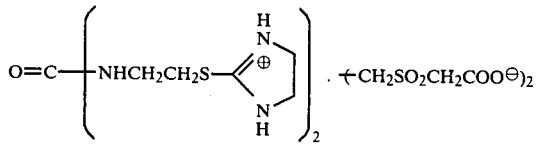

Another class of useful activators includes 2-carboxycarboxamides. These include, for example, the 2-carboxycarboxamide salts described in U.S. Pat. No. 4,088,496 of Merkel. An especially useful 2-carboxycarboxamide salt is, for example, 1,3-bis(2-amino-2-thiazolinyl)propane. N,N-ethylenebis(phthalamic acid).

Selection of an optimum activator-stabilizer compound or combination of compounds as described will depend upon a variety of factors, such as the image desired, particular photosensitive silver halide, particular developing agent, processing conditions, other components of the heat developable material and the like. Some of the activator or activator-stabilizer compounds may have limited solubility in aqueous formulations and may require some added solvents in preparation of the described heat developable photographic materials.

An activating concentration of the development activator precursor or activator-stabilizer precursor is useful in order to provide the desired reaction between the silver halide developing agent and exposed photosensitive silver halide. The optimum concentration of the development activator precursor or activator-stabilizer precursor as described can vary depending upon such factors as the desired image, processing conditions, particular developing agent and the like. A concentration of development activator precursor is typically within the range of about 0.5 to about 2.0 moles of the activator precursor per mole of silver in the heat developable material. An especially useful concentration is one within the range of 1 to 1.5 moles of the activator precursor per mole of silver in the heat developable material.

A useful embodiment of the invention is a heat developable photographic element as described wherein the activator precursor is an activator-stabilizer precursor represented by the formula:

$$Q_mA_{w'}$$

wherein Q is a protonated basic nitrogen-containing moiety selected from the group consisting of:

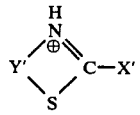

(II)

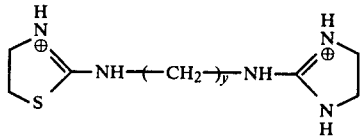

(III)

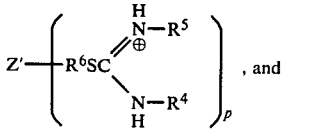

, and (IV)

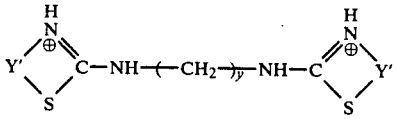

(V)

wherein Y' is alkylene containing 2 or 3 carbons; X' is $SR^7$ or $NHR^8$, wherein $R^7$ is aminoalkyl containing 2 to 6 carbon atoms, such as aminoethyl, and aminobutyl; $R^8$ is hydrogen, alkyl containing 1 to 20 carbon atoms, such as ethyl, methyl, propyl, butyl, pentyl, phenyl or aminoalkyl containing 2 to 6 carbon atoms, as described; p is 1 or 2; when p is 1, Z' is $$CH_3\overset{O}{\overset{\|}{C}}NH \quad \text{or} \quad CH_3NH\overset{O}{\overset{\|}{C}}NH\,;$$

when p is 2, Z' is a divalent linking group selected from

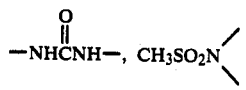

and —$SO_2$—; y is a small integer such as 2 to 6; $R^6$ is alkylene containing 1 to 12 carbon atoms, such as methyl, ethyl, propyl, butyl, pentyl and decyl, or phenylene; $R^5$ and $R^4$ are individually selected from the group consisting of hydrogen, alkyl, especially alkyl containing 1 to 12 carbon atoms, such as methyl, ethyl, and propyl; or taken together represent alkylene containing 2 or 3 carbon atoms; and wherein A' is an alphasulfonylacetate or a 2-carboxycarboxamide, and m and w are as described.

Especially useful activator or activator-stabilizer precursors within the described formulas include, for example, 1,3-bis(2-amino-2-thiazolinyl)propane.N,N'-ethylenebis(phthalamic acid) and 1,3-bis[2S-(N,N'-ethyleneisothiourea)ethyl]urea ethylenebis(sulfonylacetate).

When a combination of activator-stabilizers or activator-stabilizer precursors are used in the heat developable materials of the invention, the total concentration of activator-stabilizer or activator-stabilizer precursors is within the described concentration ranges intended to be an activating concentration.

The heat developable photographic materials, as described, can contain a variety of polymeric binders or vehicles, alone or in combination. The described components, in some instances, can be preformed as described, or can be formed in situ in the desired binder or vehicle merely by mixing the components in the presence of a solvent and the binder or vehicle. For instance, the described activator-stabilizer precursors containing an acid and base moiety can be formed in situ by mixing the acid and base portions in the presence of a solvent and suitable vehicle. Suitable binders or vehicles include both-naturally occurring substances such as proteins, for example, gelatin, gelatin derivatives, cellulose derivatives, polysaccharides such as dextran, gum arabic and the like; and synthetic polymeric materials, such as water soluble polyvinyl compounds like poly(-vinyl pyrrolidone), acrylamide polymers and the like. The layer A and/or B of the heat developable materials of the invention can also contain, alone or in combination with the described binders or vehicles, other synthetic polymeric binders or vehicle compounds such as dispersed vinyl compounds, such as in latex form, and particularly those which increase the dimensional stability of the photographic materials. If desired, the described heat developable photographic elements of the invention can contain an overcoat layer, and/or interlayer and/or subbing layer to provide added desired properties. The overcoat layer, for example, can increase resistance to abrasion and other markings on the element. The overcoat layer, interlayer and/or subbing layer can contain alone or in combination the described vehicles or binders. Useful synthetic polymers which can be used include those described in the above *Product Licensing Index* publication. Effective polymers include, for instance, water insoluble polymers of alkylacrylates and methacrylates, acrylic acid, sulfoalkylacrylates, methacrylates and those that have cross-linking sites which facilitate hardening or curing as well as those having recurring sulfobetaine units as described in Canadian Pat. No. 774,054, issued Dec. 19, 1967.

The optimum vehicle for layer B can also be within those vehicles described for layer A. It is necessary that the vehicle for layers A and B be compatible to provide the desired imaging. Typically, the vehicle for layer A is a gelatino binder.

The photosensitive layer A and layer B according to the invention can be coated on a variety of supports. Useful supports include those which are resistant to adverse changes in structure due to the processing temperatures used for development and do not adversely affect the sensitometric properties of the materials of the invention at processing temperatures. Typical supports include cellulose ester film, poly(vinyl acetal) film, poly(ethylene terephthalate) film, polycarbonate film and related films and resinous materials as well as glass, paper, metal and the like. Typically, a flexible support is most useful, especially a paper support.

An especially useful embodiment of the invention is a heat developable photographic element for providing a dye enhanced silver image comprising a support having thereon in reactive association: (A) at least one heat developable photographic layer comprising (i) photosensitive silver halide, (ii) a 3-pyrazolidone silver halide developing agent, as described, (iii) an activating concentration of an activator precursor consisting essentially of 1,3-bis(2-amino-2-thiazolinyl)propane.N,N'-ethylenebis(phthalamic acid), and (iv) a polymeric binder, as described and (B) at least one layer comprising an azoaniline dye, as described, that is bleached in the non-image areas of the element upon development of a latent image in the layer A by uniformly heating the element.

The described heat developable element, especially layer A as described, can contain a spectral sensitizing dye or combination of dyes to confer additional sensitivity to the light-sensitive silver halide. Useful spectral sensitizing dyes are described, for example, in the above *Product Licensing Index* publication. Combinations of these dyes can be useful if desired. In addition, supersensitizing addenda which do not absorb visible light may be useful in the described materials. The sensitizing dyes and other addenda useful in materials according to the invention can be incorporated into these materials from water solutions or suitable organic solvent solutions. The sensitizing dyes and other addenda can be added using various procedures, such as described in the above *Product Licensing Index* publication and known in the photographic art.

The layers A and B, and other layers of the photographic element according to the invention, as described, can be coated by various coating procedures. If desired, two or more layers can be coated simultaneously using procedures known in the photographic art.

While a variety of components and a range of concentrations of these components can be useful in a heat developable photographic element as described, an especially useful concentration range of each of these components is: within layer A (i) $10^{-4}$ to $10^{-5}$ moles of photosensitive silver halide, (ii) $10^{-4}$ to $10^{-6}$ moles of at least one active silver halide developing agent, (iii) $5\times10^{-4}$ to $2\times10^{-5}$ moles of an activator precursor, as described, and (iv) a gelatino binder and in layer B $10^{-5}$ to $10^{-6}$ moles of the described azoaniline dye/$dm^2$.

The term "bleached" as used herein is intended to mean that the azoaniline dye is changed from colored to essentially colorless in the desired areas of layer B. The bleaching can, however, involve a changing of color. However, it is essential that the bleaching that occurs provide in the image areas sufficient dye to enhance the developed silver image in layer A.

After suitable imagewise exposure of the described heat developable photographic element, an image in the photographic material can be developed by merely heating the element to a temperature within the range of about 115° C. to about 180° C., usually within the range of about 135° C. to about 165° C. until the desired dye enhanced silver image is provided. In some instances in which the activator precursor is also an activator-stabilizer precursor, the development process can include development and stabilization of the developed image.

A variety of imagewise exposure means and energy sources can be useful for providing a developable image in the described photographic material. The exposure means can be, for example, a light source, a laser, an electron beam, X-rays and the like.

An image is typically developed by heating the photographic material to a temperature within the described temperature range for about 1 to about 60 seconds, such as about 1 to about 30 seconds. By increasing or decreasing the time of heating, a higher or lower temperature within the described range can be useful.

Processing is usually carried out under ambient conditions of pressure and humidity. Pressures and humidity outside normal atmospheric conditions can be useful if desired; however, normal atmospheric conditions are preferred.

Various means are useful for providing the necessary heating of the element after exposure. The photographic element, as described, can be brought into contact with a simple hot plate, iron, rollers, dielectric heating means or the like.

Small concentrations of moisture can be present during processing such as the concentrations of moisture present in conventional photographic paper supports at atmospheric conditions, such as at about 25° C. and 40% relative humidity.

The silver halide photosensitive materials, described, can be washed or unwashed to remove soluble salts after precipitation of the silver halide; can be chemically sensitized; can contain development modifiers that function as speed-increasing compounds; and can contain antifoggants and emulsion stabilizers as described in the *Product Licensing Index,* Volume 92, December 1971, publication 9232, published by Industrial Opportunities Ltd., Homewell, Havant, Hampshire, P09 1EF, UK. The photographic materials can also contain hardeners, antistatic layers, plasticizers, lubricants, coating aids, matting agents, brighteners, absorbing and filter dyes which do not adversely affect the desired properties of the heat developable materials of the invention and other addenda as described, for example, in the above *Product Licensing Index* publication.

While a useful arrangement of layers in a photographic element according to the invention is described and shown in FIG. 1, it can be in some cases desirable to have the layer A between the described support and layer B. In this instance, the support can, for example, be transparent to permit imagewise exposure through the support rather than directly to layers A or B. While it is possible to use different layer arrangements, it is necessary that layers A and B be contiguous to permit the transfer of oxidized developing agent to the desired location of the azoaniline dye to permit desired image formation. Typically layer A is coated on layer B or layer B is coated on layer A. If a layer is used between layer A and layer B, it is necessary that this intermediate layer permit the desired degree of transfer of oxidized developing agent as described.

In selecting useful dyes for layer B, a combination of tests can be useful. A solution test to determine suitable dyes can be useful as described in following Example 8. This can be used in combination with the film test to determine the suitable dyes as described in following Example 9.

The following examples are included for a further understanding of the invention. Those examples which relate to dyes which are not azoaniline dyes are comparative examples.

EXAMPLE 1

Photothermographic material and process containing layers A and B containing an azoaniline dye A photothermographic material was prepared having the layer arrangement as described in FIG. 1 of the drawings.

The following dye:

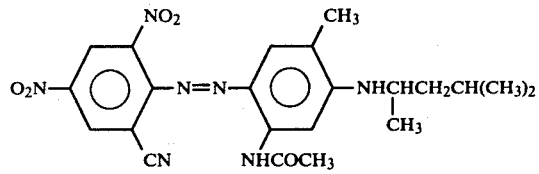

(30 milligrams) in 10 ml of a 4% dichlormethane solution of cellulose acetate was coated at a 4-mil wet coating thickness on a poly(ethylene terephthalate) film support. The resulting coating (layer B) was permitted to dry and then overcoated with a mixture of the following:

| | |
|---|---|
| 4-methyl-4-hydroxymethyl-1-phenyl-3-pyrazolidone (referred to herein as MOP) | 75 mg |
| 2-amino-2-thiazolinium trichloroacetate (referred to herein as TAT) | 500 mg |
| 2% photographic gelatin in water | 10 ml |
| silver bromoiodide gelatino emulsion (0.09 micron grain size, 6% iodide) | 1 ml |
| Surfactant (5% by weight surfactant 10G) (a nonylphenoxypolyglycidol available from the Olin Corp., USA, known as Surfactant 10G) | 0.2 ml |

The resulting composition was overcoated on the layer B at a wet coating thickness of 4 mils. This provided a silver coverage of 130 milligrams of silver per $ft^2$ (13 mg of silver per square decimeter). The resulting layer A was permitted to dry to provide a photothermographic element according to the invention. The photothermographic element was then imagewise exposed to roomlight to provide a developable latent image and the resulting exposed element was heated for the necessary combination of time and temperature described in following Table E I to provide a difference in dye density between the unexposed and exposed areas of the film. The following results were obtained as provided in Table E I.

Table E I

| Process | | | | Visual Density ($D_{max}$) | | | |
|---|---|---|---|---|---|---|---|
| | | | | Ag + Dye | | Dye* | |
| Time (secs.) | | Temp. (°C.) | | Exposed | Unexposed | Exposed | Unexposed |
| (a) | 10 | 138 | | 2.5 | 1.6 | 1.3 | 1.3 |
| (b) | 20 | 175 | | 2.2 | 0.6 | 0.9 | 0.5 |
| | 10 at | 138 | followed | | | | |
| (c) by | 20 at | 175 | | 2.7 | 0.3 | 1.0 | 0.4 |

*Layer A was removed with warm water to reveal the dye only image.

A control coating like that described above but from which layer B containing the dye was missing provided the following results given in Table E II.

Table E II (Control)

| Process | | | | Visual Density ($D_{max}$) (Ag only) | |
|---|---|---|---|---|---|
| Time (secs.) | | Temp. (°C.) | | Exposed | Unexposed |
| | 10 | 140 | | 1.43 | 0.09 |
| | 10 at | 140 | followed | | |
| by | 20 at | 175 | | 1.61 | 0.11 |

The comparison of results provided indicate that the silver image in layer A was clearly enhanced by the dye image in the other layer of the photothermographic element.

EXAMPLE 2

Variation of concentration

The photothermographic materials and procedures of Example 1 were repeated with differing concentration ranges as follows:

| | |
|---|---|
| MOP | 2.25- 6.4 mg/dm$^2$ |
| TAT | 11.0-37.5 mg/dm$^2$ |

-continued

| | |
|---|---|
| AgBrI emulsion | 3.5-10.0 mg/dm$^2$ |

These examples included both single step and two-step heat processing, as described in Table E I. In each case the heating was stopped when the minimum density area was transparent, that is, when the $D_{min}$ area cleared. The results of this processing are given in following Table E III. For these examples, it is to be noted that regardless of the coating composition and processing conditions, essentially the same dye density ($D_{max}$ 0.5-0.6 and $D_{min}$ 0.25) was obtained in each case.

Table E III

Examples of Process of Invention With Concentration Ranges

| Compound | Quantity (mg/dm$^2$) | Processing Time (Sec/°C.) | $D_{max}$ Ag + Dye | $D_{max}$ Ag | $D_{max}$ Dye | $D_{min}$ Ag + Dye | $D_{min}$ Ag | $D_{min}$ Dye |
|---|---|---|---|---|---|---|---|---|
| MOP | 3.4 | | | | | | | |
| TAT | 11.0 | 120"/160 | 1.4 | 1.0 | 0.6 | 0.24 | 0.04 | 0.22 |
| AgX[a] | 5.7 | | | | | | | |
| Dye[c] | 2.25 | 20"/130 followed by 20"/180 | 1.75 | 1.25 | 0.5 | 0.2 | 0.05 | 0.27 |
| MOP | 6.4 | | | | | | | |
| TAT | 37.5 | 20"/160 | 1.75 | 1.25 | 0.5 | 0.34 | 0.13 | 0.27 |
| AgX[b] | 10.0 | | | | | | | |
| Dye[c] | 2.25 | | | | | | | |
| MOP | 2.25 | | | | | | | |
| TAT | 34.0 | 60"/115 followed by 60"/160 | 0.9 | 0.4 | 0.5 | 0.25 | 0.04 | 0.21 |
| AgX[b] | 3.5 | | | | | | | |
| Dye[c] | 2.25 | | | | | | | |

[a]AgBrI emulsion A-This a silver bromoiodide gelatino emulsion containing 2.5 mole % iodide and havine a 0.09 micron grain size.
[b]AgBrI emulsion B-This a silver bromoiodide gelatino emulsion containing 2.5 mole % iodide and having a 0.09 micron grain size.
[c]Dye 22 described in Table E IX.

EXAMPLE 3

Different binder

The photothermographic materials and procedures of Example 1 were repeated with the exception that poly(vinyl butyral) (commercially available as Butvar B-76) was used as a binder for the dye in place of cellulose acetate in the dye layer.

The destruction of the dye by MOP is very rapid in poly(vinyl butyral), and competitive in rate with the silver halide development process in the layer containing silver halide. However, a low density dye image can be obtained at short processing times, that is 2 to 5 seconds.

The following results were obtained as provided in Table E IV.

Table E IV

| Compound | Amount (mg/dm$^2$) | Process* | $D_{max}$ Ag + Dye | $D_{max}$ Dye | $D_{min}$ Ag + Dye | $D_{min}$ Dye |
|---|---|---|---|---|---|---|
| MOP | 4.5 | 2"/160 | 1.2 | 0.55 | 0.46 | 0.35 |

Table E IV-continued

| Compound | Amount (mg/dm²) | Process* | $D_{max}$ Ag + Dye | $D_{max}$ Dye | $D_{min}$ Ag + Dye | $D_{min}$ Dye |
|---|---|---|---|---|---|---|
| TAT | 37.5 | | | | | |
| Dye 22 | 2.25 | 5"/160 | 1.05 | 0.42 | 0.32 | 0.26 |
| Butvar B-76 on unsubbed poly(ethylene terephthalate film support | 15.0 | | | | | |

*Time in seconds/temperature in °C.

EXAMPLE 4

Combination of developing agents

It was found that in some cases ascorbic acid as the developer developed the layer containing silver halide but did not satisfactorily bleach the dye in the dye-containing layer with a certain binder. This apparently was caused by lack of sufficient penetration of the developer moiety into the cellulose acetate binder containing layer, even when the photothermographic element was heated at 180° C. for 60 seconds. This indicates that selection of a suitable binder for the dye-containing layer may be significant to provide the desired transfer of the developer moiety into the dye-containing layer. Further, when hydroquinone is used as the developing agent, the developer moiety completely bleaches the dye in the dye-containing layer but does not satisfactorily develop the latent image in the silver halide containing layer. This indicates that a combination of components must be selected when hydroquinone is used alone as a developing agent to balance the desired reaction mechanisms. However, useful results are obtained by a combination of ascorbic acid with a certain concentration of hydroquinone in the layer containing the silver halide. A concentration of 0.19 milligrams of hydroquinone per square decimeter of photothermographic element is typically useful with ascorbic acid. This concentration, however, can be different with different binders in each of layers A and B and different activator or activator-stabilizer precursors.

Useful results were obtained by a combination of ascorbic acid with 0.19 milligram per square decimeter of hydroquinone as illustrated in following Table E V.

EXAMPLE 5

Dispersion of coupler solvent with developing agent and dye

The procedures described in the above examples were repeated with ascorbic acid as the developing agent but with the described dye dispersed in a phenolic coupler solvent referred to herein as coupler solvent A in the silver halide containing layer rather than in an undercoat. The coupler solvent A as referred to herein is intended to mean 2,4-di-tertiary-amylphenol. It was found that upon heating the photothermographic element containing the coupler solvent after imagewise exposure that the dye in the dye-containing layer was destroyed or bleached uniformly rather than in preference to the image areas of the silver halide containing layer. In addition, it was observed that the photothermographic coatings on gel subbed poly(ethylene terephthalate) film support or on cellulose acetate film support were free of undesired pinholes or blisters in the coatings. This result was believed not caused by the surfactant used in the preparation of the dispersion. Accordingly, by using a dispersion of coupler solvent A, ascorbic acid can be overcoated upon a layer containing a dye in cellulose acetate and the desired properties of the coating maintained upon heating the photothermographic element.

Typical results of this heat processing are given in following Table E VI. The maximum density-minimum density ratios in dyes are similar to those obtained with the use of a silver halide containing layer containing MOP with cellulose acetate. Two differences, however, are to be noted: (a) the level of ascorbic acid required is significantly less than that of MOP and (b) the maintenance of a high level of aminothiazoline in the silver halide containing layer was significant. It was observed that improved results were obtained in processing the film by providing contact of the side of the film opposite the support with the heating means.

Table E V

Effect of Hydroquinone on Ascorbic Acid Performance/Dye in Cellulose Acetate

| Compound | Amount (mg/dm²) | Processing Time (Sec/°C.) | $D_{max}$ Ag + Dye | $D_{max}$ Dye | $D_{min}$ Ag + Dye | $D_{min}$ Dye |
|---|---|---|---|---|---|---|
| Ascorbic Acid | 1.5 | | | | | |
| TAT | 22.5 | 60"/180 | 1.90 | 1.22 | 1.20 | 1.17 |
| AgX[a] | 5.7 | | | | | |
| Dye 22 | 2.25 | | | | | |
| T-1** | 30.0 | | | | | |
| above + hydroquinone | 0.19 | 60"/160 | 1.52 | 0.74 | 0.6 | 0.55 |
| above + hydroquinone | 0.28 | 30"/135 followed by 30"/160 | 1.84 | 1.2 | 0.8 | 0.8 |

[a]AgBrI emulsion A

**T-1 as used in this table and in other tables herein means cellulose acetate.

Table E VI

Use of Dispersion of Coupler Solvent A With Ascorbic Acid/Dye in Cellulose Acetate

| Ingredients | Amount (mg/dm²) | Processing Time (Sec/°C.) | $D_{max}$ Ag | $D_{max}$ Ag + Dye | $D_{max}$ Dye | $D_{min}$ Ag | $D_{min}$ Ag + Dye | $D_{min}$ Dye |
|---|---|---|---|---|---|---|---|---|
| AA* | 1.2 | | | | | | | |
| TAT | 22.5 | 20"/160 | 0.62 | — | — | 0.13 | | |
| AgX[a] | 5 | face down** | | | | | | |
| Coupler Solvent A | 18 | | | | | | | |
| above + Dye 21 | 2.25 | 30"/160 | — | 0.93 | 0.54 | — | 0.24 | 0.22 |
| T-1 | 30 | face down** | | | | | | |
| AA* | 0.57 | | | | | | | |
| TAT | 22.5 | | | | | | | |
| AgX[a] | 2.5 | 90"/160 | 0.32 | 0.86 | — | 0.1 | 0.4 | — |
| Coupler Solvent A | 18 | | | | | | | |
| Dye 21 | 1.5 | | | | | | | |
| T-1 | 15 | | | | | | | |
| AA* | 0.94 | | | | | | | |
| MOP | 0.18 | 15"/160 | — | 1.05 | 0.65 | — | 0.42 | 0.35 |
| AgX[a] | 2.5 | face down** | | | | | | |
| Coupler Solvent A | 18 | | | | | | | |
| Dye 21 | 1.5 | | | | | | | |
| T-1 | 15 | | | | | | | |

[a]AgBrI emulsion A
*AA as described herein is ascorbic acid.
**face down means that the side of the heat developable photographic element containing the silver halide was contacted with the heating means.

EXAMPLE 6

Processing temperature latitude

The procedures of Example 1 were repeated with the following components in layers A and B as described:

| | | |
|---|---|---|
| layer A: | | |
| ascorbic acid | 0.6 | mg/dm² |
| TAT | 22.5 | mg/dm² |
| photographic gelatin | 15 | mg/dm² |
| silver bromoiodide emulsion A | 2.5 | mg/dm² |
| layer B: | | |
| dye 21 as described herein | 1.5 | mg/dm² |
| poly(vinyl butyral) | 15 | mg/dm² |

The layers were coated on a poly(ethylene terephthalate) film support.

Dye 21 used in layer B has the following structure:

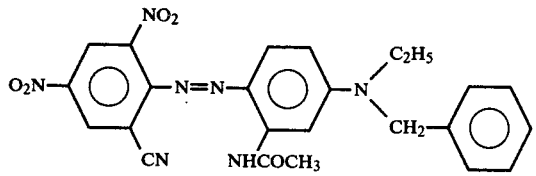

The processing temperatures used for heating the imagewise exposed photothermographic element and the results obtained upon heating are given in following Table E VII. The results indicate, among other things, that ascorbic acid has no difficulty bleaching dye 21 in a poly(vinyl butyral) binder. The sensitometry of the photothermographic element is not significantly changed over a processing temperature range of 115° C. to 160° C.

Table E VII

The Process of the Invention with Ascorbic Acid/Dye in poly(vinyl butyral) - The Effect of Temperature at a Constant Heating Time of 30 Sec.

| | Temp. (°C.) | 100 | 115 | 125 | 135 | 150 | 160 |
|---|---|---|---|---|---|---|---|
| Ag + Dye | $D_{max}$ | 1.08 | 0.96 | 0.85 | 0.85 | 0.89 | 0.87 |
| | $D_{min}$ | 1.08 | 0.35 | 0.35 | 0.38 | 0.52 | 0.44 |

Table E VII-continued

The Process of the Invention with Ascorbic Acid/Dye in poly(vinyl butyral) - The Effect of Temperature at a Constant Heating Time of 30 Sec.

| | Temp. (°C.) | 100 | 115 | 125 | 135 | 150 | 160 |
|---|---|---|---|---|---|---|---|
| Dye | $D_{max}$ | 0.88 | 0.62 | 0.62 | 0.60 | 0.71 | 0.63 |
| | $D_{min}$ | 0.88 | 0.35 | 0.35 | 0.38 | 0.50 | 0.44 |

EXAMPLE 7

Developer concentration range

The procedures described in Example 1 were repeated with the following components in layers A and B as described:

| | | |
|---|---|---|
| layer A: | | |
| ascorbic acid | concentration as indicated in following Table E VIII | |
| TAT | 22.5 | mg/dm² |
| silver bromoiodide emulsion A | 2.5 | mg/dm² |
| photographic gelatin | 15 | mg/dm² |
| layer B: | | |
| dye 21 as described in Example 6 (density = 0.90) | 1.5 | mg/dm² |
| poly(vinyl butyral) | 15.0 | mg/dm² |

The described layers of this example were coated on a poly(ethylene terephthalate) film support. The photothermographic element was imagewise exposed to light and then uniformly heated as described in Example 1. The results of this processing are given in following Table E VIII. The results indicate that a desired image can be obtained with 0.9 milligrams/dm² of the described developing agent. However, it is to be noted that little difference is found in the maximum density-minimum density ratios in dye or silver with dye over the range of 0.6 to 2.2 mg/dm² of the developer under the same processing conditions.

Table E VIII

Process with Ascorbic Acid/Dye in poly(vinyl butyral) - Effect of Ascorbic Acid Concentration

| Ascorbic Acid | $D_{max}$ | | $D_{min}$ | |
|---|---|---|---|---|
| (mg/dm$^2$) | Ag + Dye | Dye | Ag + Dye | Dye |
| 0.6 | 0.96 | 0.62 | 0.35 | 0.35 |
| 0.9 | 1.04 | 0.52 | 0.22 | 0.22 |
| 2.2 | 1.06 | 0.52 | 0.24 | 0.20 |

EXAMPLE 8

Solution test for suitable dyes

In selecting an optimum dye for the layer B, as described, it is often useful to provide a screening test to determine which dyes do not react with the described components in layer A. For example, a screening test can be useful to determine which dyes do not react with the described aminothiazoline activator precursor, but which would react with either ascorbic acid or the combination of ascorbic acid with the aminothiazoline activator precursor and therefore be of potential usefulness in the process and materials of the invention. A useful solution test for screening of dyes consists of heating each dye in a concentration sufficient to provide an optical density of approximately 1.0 with: (a) 2 ml of $2\times10^{-2}$ M ascorbic acid in bis-(2-methoxyethyl)ether plus an additional 2 ml of this solvent, (b) 2 ml of $7.5\times10^{-2}$ M aminothiazoline in bis-(2-methoxyethyl)ether plus an additional 2 ml of this solvent, and (c) 2 ml of the ascorbic acid solution and 2 ml of the aminothiazoline solution.

Bis-(2-methoxyethyl)ether was selected as a solvent due to its high dielectric constant and its ability to solvate charged transition states. Each dye was heated for 15 minutes in the screening test on a steam bath under these three conditions and the dye fading observed visually.

A series of azoaniline dyes was tested in the described screening process and solutions. Those azoaniline dyes which were tested and the results of the test are given in following Table E IX. None of the dyes tested reacted with the ascorbic acid alone or with aminothiazoline alone. However, many were faded by the combination of ascorbic acid with the aminothiazoline.

In certain azoaniline dyes it is believed that the hue deepens as the polarity of the dye increases by substitution of electron withdrawing groups in the non-aniline ring. Thus, as the color shifts from, for example, yellow to blue, the dyes become progressively more prone to reduction, for example, by silver in the silver dye bleach process, and correspondingly more prone to nucleophilic attack. In the present screening test, there does not appear to be a differentiation between nucleophilic displacement and reduction. The products from both of these reactions appear to be yellow in color in certain classes of azoaniline dyes. In order to make a yellow azoaniline dye and an orange azoaniline dye fade, it is necessary to use dyes formed from a suitable coupler.

Comparative tests were carried out with indoaniline and indophenol dyes given in following Table E XI. It was observed that with ascorbic acid and aminothiazole that all the cyan dyes were bleached, magenta dyes were marginally bleached and yellow dyes did not significantly fade. In the case of indophenol dyes, all of the indicator dyes were bleached.

To evaluate the results in comparison to other dyes, a wide variety of azophenol, azopyrazolone, anthraquinone, cyanoethylene, and methine dyes were tested. A wide variety of these dyes did not react with the heated solution of ascorbic acid and aminothiazoline. The results of solution tests with azoaniline dyes are given in following Table E IX:

Table E IX

Solution Test Results on Azoaniline Dyes

| Dye Number | Dye Structure | Test Result* |
|---|---|---|
| 1 | 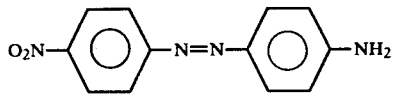 | N |
| 2 | 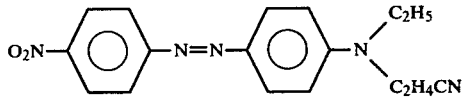 | N |
| 3 | 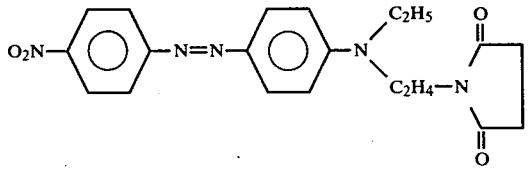 | Y (Yellow)+ |
| 4 | 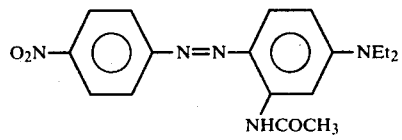 | Y (Yellow) |

Table E IX-continued
Solution Test Results on Azoaniline Dyes
| Dye Number | Dye Structure | Test Result* |
|---|---|---|
| 5 | 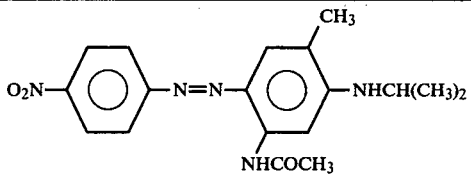 | Y (Orange) |
| 6 | 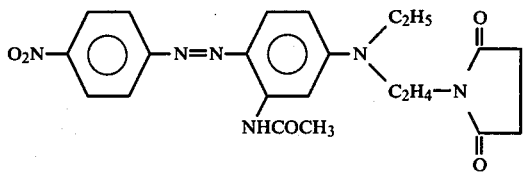 | Y (Yellow) |
| 7 | 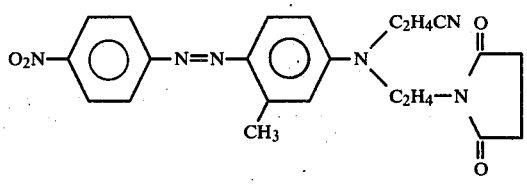 | N |
| 8 | 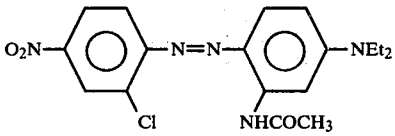 | Y (Colorless) |
| 9 | 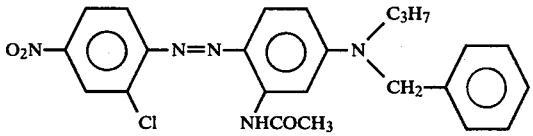 | Y (Yellow) |
| 10 | 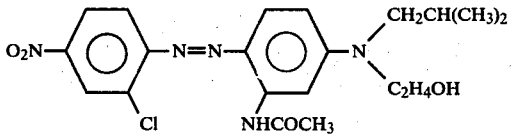 | Y (Orange) |
| 11 | 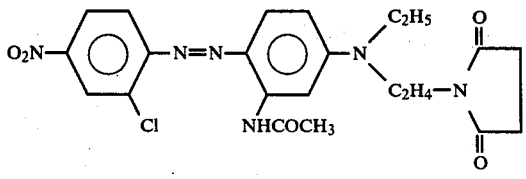 | Y (Yellow) |
| 12 | 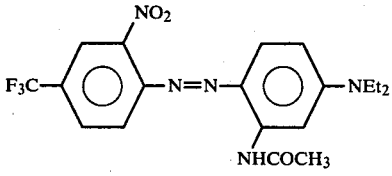 | Y (Colorless) |
| 13 | 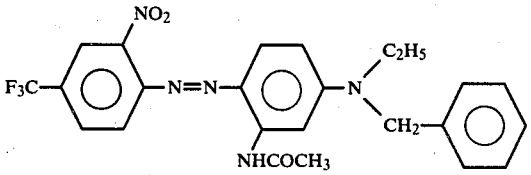 | Y (Yellow) |

Table E IX-continued
Solution Test Results on Azoaniline Dyes
| Dye Number | Dye Structure | Test Result* |
|---|---|---|
| 14 | 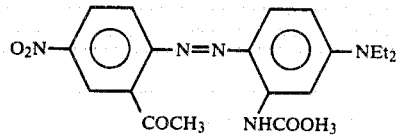 | Y (Yellow) |
| 15 | 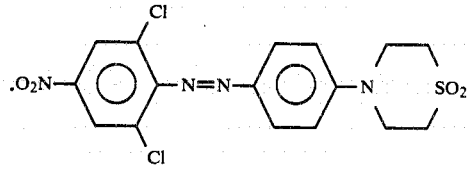 | N |
| 16 | 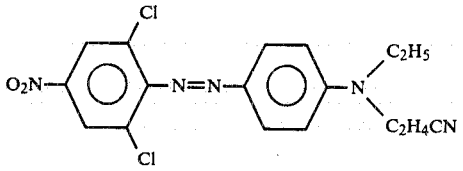 | N |
| 17 | 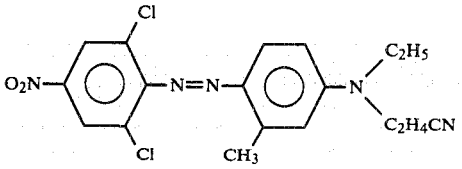 | N |
| 18 | 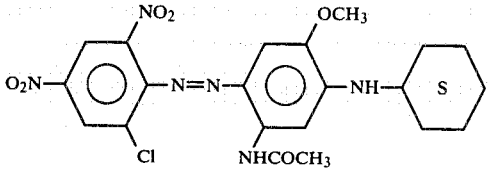 | Y (Brown) |
| 19 | 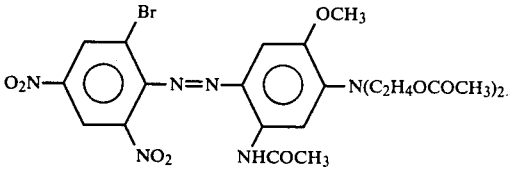 | Y (Yellow) |
| 20 | 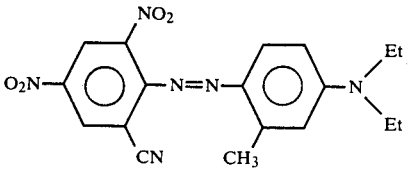 | Y (Yellow) |
| 21 | 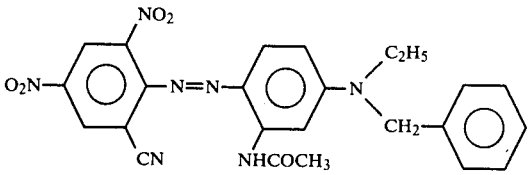 | Y (Brown) |
| 22 | 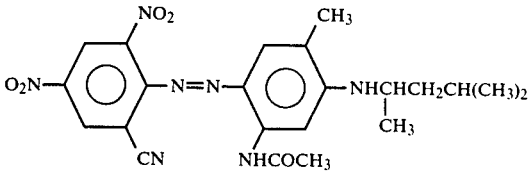 | Y (Orange) |

Table E IX-continued
Solution Test Results on Azoaniline Dyes
| Dye Number | Dye Structure | Test Result* |
|---|---|---|
| 23 | 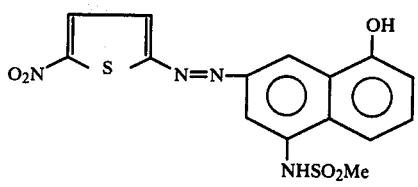 | Y (Brown) |
| 24 | 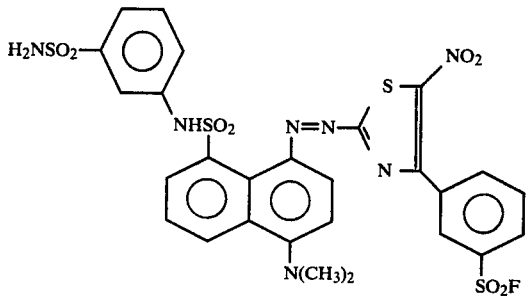 | Y |
| 25 | 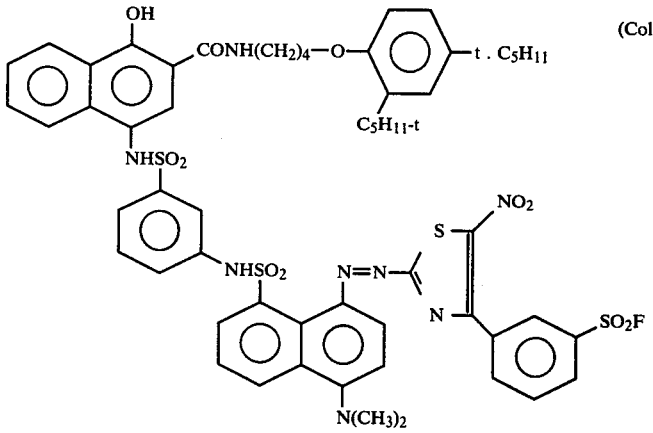 | Y (Colorless) |
| 26 | 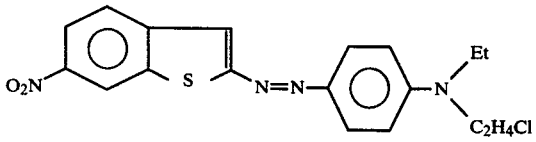 | Y (Colorless) |
| 27 | 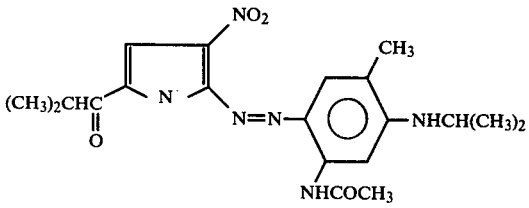 | Y (Colorless) |
| 28 | 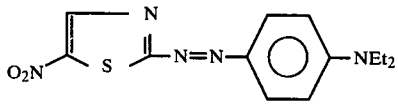 | Y |
| 29 | 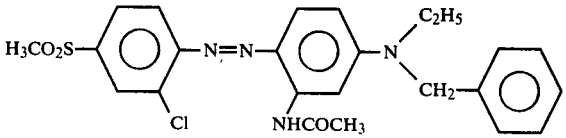 | Y |

Table E IX-continued

Solution Test Results on Azoaniline Dyes

| Dye Number | Dye Structure | Test Result* |
|---|---|---|
| 30 | 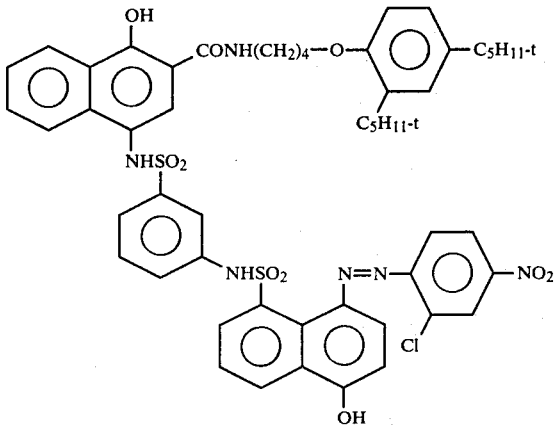 | Not tested |
| 31 | 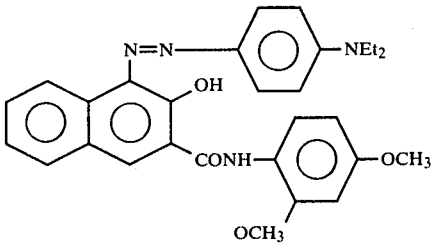 | Not tested |

*None of these dyes reacted with ascorbic acid alone or with aminothiazoline alone. 'N' indicates that a particular dye was not faded by the combination and 'Y' indicates that the dye was faded by the combination.
+Color of dye solution after reaction.

The results of similar testing for indoaniline dyes are given in following Table E X:

Table E X (Comparative Examples)
Dye Screening: Solution Test - Indoaniline Dyes

| Dye Number | Dye Structure | Fading Results |
|---|---|---|
| 32 | 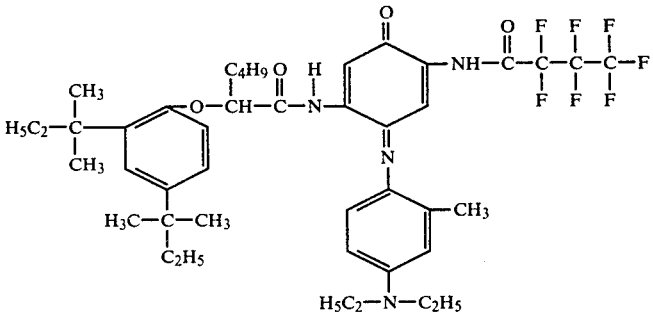 | Y |
| 33 | 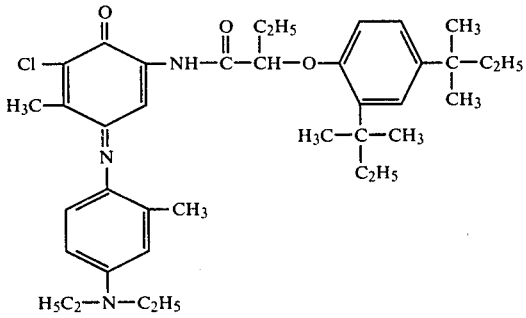 | Y |

Table E X-continued
(Comparative Examples)
Dye Screening: Solution Test - Indoaniline Dyes
34
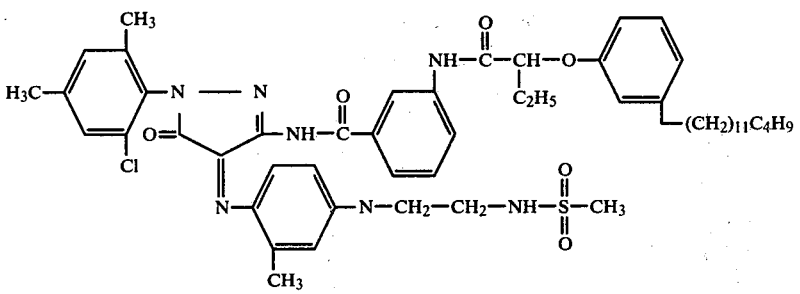
Y
35
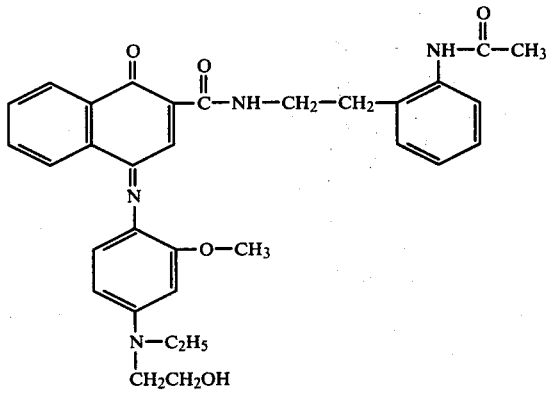
Y
36
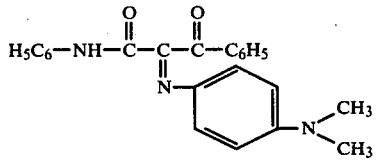
No
37
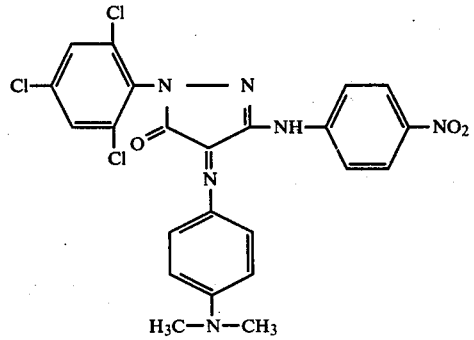
Slowly
38
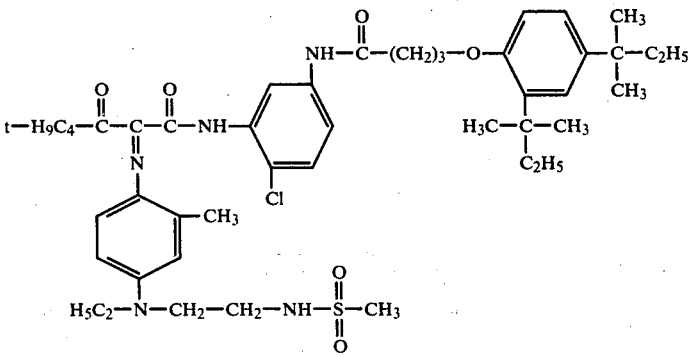
No Table E X-continued (Comparative Examples)

Dye Screening: Solution Test - Indoaniline Dyes

39

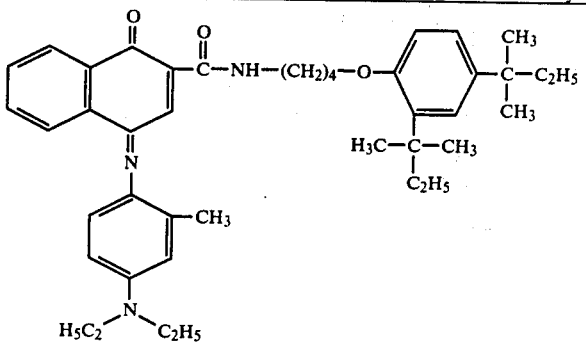

Y

Dye Screening: Solution Test - Indophenol Dyes

| Dye Number | Dye Structure | Fading Results |
|---|---|---|
| 40 | 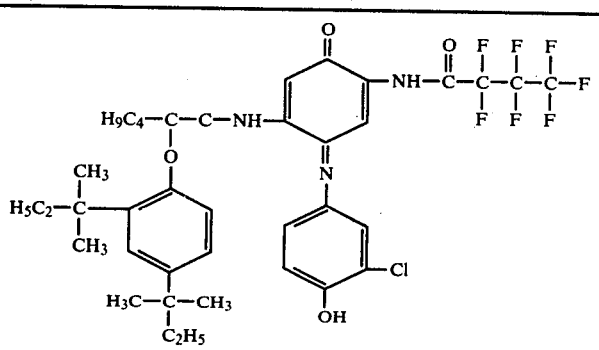 | Y |
| 41 | 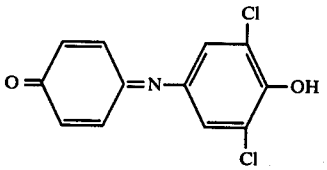 | Y |
| 42 | 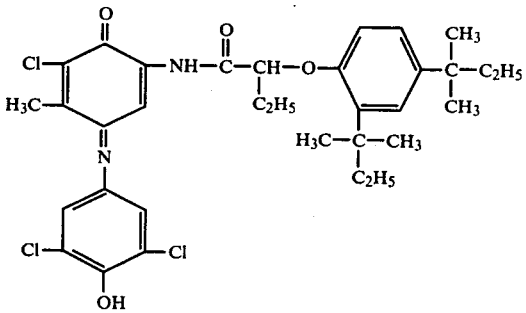 | Y |
| 43 | 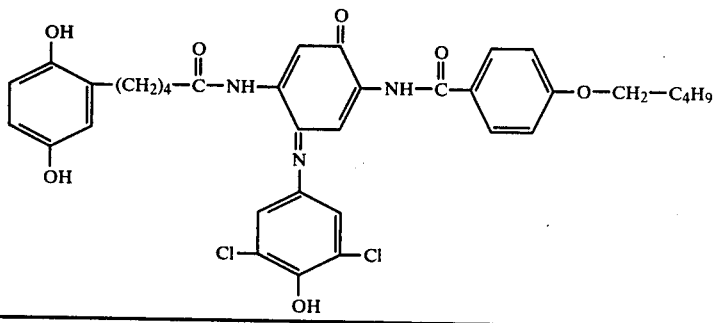 | Y |

*"No" indicates that a particular indoaniline dye was not faded by the combination of ascorbic acid with aminothiazoline and "Y" indicates that the dye was faded by the combination.

"Slowly" means that the particular dye faded slowly when mixed with the combination.

EXAMPLE 9

Screening test for suitable dyes

A screening test for useful dyes was also carried out with a photothermographic element, as described in Example 1, in which a dye was present in a cellulose acetate layer overcoated with a photothermographic layer containing the pyrazolidone developing agent. This was Film Test I. Details and results of this test are given in following Table E XI and Table E XII comparing the described dyes.

A further film screening test for useful dyes was carried out in which the dye was present in a cellulose acetate layer overcoated with a photothermographic layer containing ascorbic acid with the 3-pyrazolidone developing agent plus a coupler solvent dispersion in the photothermographic element. This was Film Test II. The details and results of this second screening test are given in following Table E XIII with comparison to other results in Table E XI.

Table E XI

| | A Comparison of Test Results | | |
|---|---|---|---|
| Dye Number | Solution Test* | Film Test I* | Film Test II* |
| 1 | N | N | — |
| 2 | N | — | — |
| 3 | Y | — | — |
| 4 | Y | — | Y |
| 5 | Y | — | — |
| 6 | Y | — | — |
| 7 | N | — | — |
| 8 | Y | — | Y |
| 9 | Y | — | — |
| 10 | Y | N | — |
| 11 | Y | — | — |
| 12 | Y | Y | Y |
| 13 | Y | Y | — |
| 14 | Y | — | Y |
| 15 | N | — | — |
| 16 | N | — | — |
| 17 | N | — | faint |
| 18 | Y | Y | — |
| 19 | Y | — | Y |
| 20 | Y | Y | — |
| 21 | Y | — | — |
| 22 | Y | — | — |
| 23 | Y | — | — |
| 24 | — | — | — |
| 25 | Y | — | Y |
| 26 | Y | — | Y |
| 27 | Y | Y | Y |
| 28 | — | Y | — |
| 29 | Y | — | — |

*A dash means the dye was not tested. "N" means that the dye was not faded and "Y" means the dye was faded in the non-image areas.

Table E XII

| | Dye Screening: Dye in T-1/MOP* | | |
|---|---|---|---|
| Dye Number | Color | Processing Conditions (Sec/°C.) | Image |
| 32 | cyan | 30/135 | Yes |
| 33 | cyan | 30/135 | Yes |
| 13 | orange | 45/160 | Yes |
| | Dye Screening: Dye in T-1/MOP** | | |
| 1 | yellow | 60/180 | No |
| 27 | blue | 60/180 | Yes |
| 28 | blue | 60/180 | Yes |
| 12 | red | 60/180 | Yes |
| 13 | red-orange | 60/180 | Yes |
| 18 | blue | 60/180 | Yes |
| 10 | red | 60/180 | No |
| 20 | violet | 60/180 | Yes |
| 400 | yellow | 60/180 | No |
| 401 | yellow | 60/180 | No |

Table E XII-continued

| | | | |
|---|---|---|---|
| 402 | magenta | 60/180 | No |

*30 mg of each dye in 10 ml of 5% by weight cellulose acetate was coated at a 3 mil wet coating thickness on a poly(ethylene terephthalate) film support and overcoated with a mixture of MOP (100 mg/dm$^2$ of support), TAT (500 mg/dm$^2$ of support), silver bromoiodide emulsion A (1 ml), 4 drops of 10% by weight Surfactant 10G in water and 2% by weight gelatin (10 ml) at 3 mil wet coating thickness.

**20 mg of each dye in 10 ml of 4% by weight cellulose acetate in dichloromethane was coated at 3 mil wet coating thickness on a poly(ethylene terephthalate) film support and then overcoated with a mixture of MOP (50 mg), TAT (250 mg), silver bromoiodide emulsion A (0.5 ml), 0.15 ml of 10% by weight Surfactant 10G in water, 2% by weight photographic gelatin (3 ml) and water (7 ml) at a wet coating thickness of 3 mils.

Table E XIII

| | Dye Screening: Dye in T-1 cellulose acetate/ ascorbic acid plus MOP with coupler solvent dispersion* | | |
|---|---|---|---|
| Dye Number | Color | Conditions (Sec/°C.) | Image |
| 43 | pink-blue$^{+}$ ‡ | 45/115 | Yes |
| 25 | cyan | 30/115 | Yes |
| 30 | yellow → cyan$^{+}$ ‡ | 30/160 | Yes |
| 31 | blue | 30/160 | No |
| 27 | blue | 30/160 | Yes |
| 14 | magenta | 15/180 | Yes |
| 12 | orange | 120/180 | Yes |
| 8 | magenta | 180/160 | Yes |
| 26 | magenta | 180/160 | Yes |
| 4 | red | 180/160 | Yes |
| Dye Number | Color | Conditions | Image |
| 300 | yellow | 120/180 | No |
| 19 | blue | 10/160 | Yes |
| 17 | orange | 120/180 | faint |

*Coating consisted of layer A on layer B on gel-subbed poly(ethylene terephthalate. Coupler solvent A was used.

Layer A: A mixture of 2,4-di-t-amylphenol (2 ml), 5% by weight Alkanol B (3 ml), 2% gel (72 ml) and 10% Surfactant 10G dispersed together for 5 minutes with a polytron. This dispersion (50 ml) was then mixed with a mixture consisting of TAT (3.6 g), ascorbic acid (90 mg), MOP (30 mg), 10% Surfactant 10G (30 drops), 2% gel (60 ml) and AgBrI emulsion A (3 ml) and coated at 3 mil.

Layer B: Dye in amount indicated dissolved in a 2% solution of T-1 in a 2% solution of T-1 cellulose acetate (10 ml) in dichloromethane and coated at 3 mil.

‡ Color shift upon release of base.

EXAMPLE 10

Halation protection

It was observed in those photothermographic materials described in the preceding examples that halation protection was provided. Accordingly, the described dye layer of the photothermographic element of the invention provides both halation protection and dye image enhancement.

It was also observed that if only halation protection is desired, then the concentration of dye used need not be as high as those cases in which both halation protection and dye image enhancement are desired. The halation protection can be provided when sufficient dye is included in the dye layer to provide a density of about 0.3. The described photothermographic elements provide halation protection and desired dye bleaching using, for example, dyes which absorb in the red and in the red-green regions, such as Dye 33 and Dye 21, respectively in a photothermographic element containing a poly(vinyl butyral) binder under a photothermographic layer containing a photosensitive composition containing MOP, TAT and photosensitive silver halide as described in Example 1.

The azo dyes listed in Example 8 can be bleached by suitable nucleophiles. If such a suitable nucleophile is generated imagewise, then the reaction with dye produces a reversal image in the dye. An example of this is a photothermographic element containing a photoreductive quinone coated with a cobalt hexamine complex and the dye. Upon irradiation the photoreduced quinone reduces the cobalt complex and releases the amine. Heating the coating following the imagewise exposure caused the destruction of the dye by the amine in the image areas resulting in a positive blue dye image in the dye-containing layer.

The invention has been described in detail with particular reference to preferred embodiments thereof, but it will be understood that variations and modifications can be effected within the spirit and scope of the invention.

What is claimed is:

1. A heat developable, photographic element for providing a dye enhanced, silver image comprising a support having thereon:

(A) at least one heat developable layer comprising
- (i) photosensitive silver halide,
- (ii) at least one active silver halide developing agent,
- (iii) an activating concentration of a development activator precursor, and
- (iv) a polymeric binder, and, contiguous to this layer (A), (B) at least one layer comprising an azoaniline dye that upon development of a latent image in said layer (A) by uniformly heating is bleached in the non-image areas of said element.

2. A heat developable, photographic element for providing a dye enhanced silver image comprising a support having thereon:

(A) at least one heat developable, photographic layer comprising
- (i) photosensitive silver halide,
- (ii) at least one active silver halide developing agent,
- (iii) an activating concentration of a development activator precursor, and
- (iv) a gelatino binder, and, contiguous to this layer (A), (B) at least one layer comprising at least one azoaniline dye selected from the group consisting of

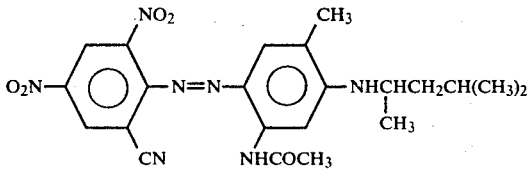

and

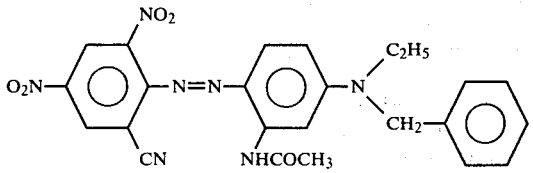

and combinations thereof.

3. A heat developable, photographic element as in claim 1 wherein said activator precursor is an activator-stabilizer precursor represented by the formula:

$Q_mA_w'$ wherein Q is a protonated basic nitrogen containing moiety selected from the group consisting of

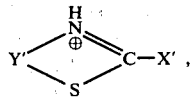

(II)

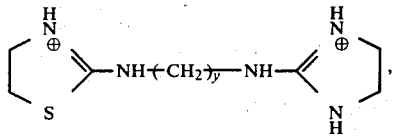

(III)

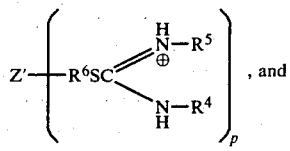

(IV)

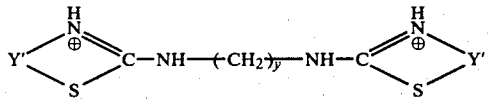

(V)

wherein

Y' is alkylene containing 2 or 3 carbons;

X' is $SR^7$ or $NHR^8$, wherein $R^7$ is aminoalkyl containing 2 to 6 carbon atoms; $R^8$ is hydrogen, alkyl containing 1 to 20 carbon atoms, phenyl, or aminoalkyl containing 2 to 6 carbon atoms;

p is 1 or 2; when p is 1, Z' is

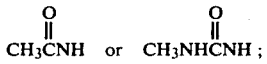

when p is 2, Z is a divalent linking group selected from

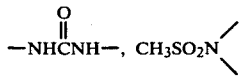

and —$SO_2$—; y is 1 to 6;

$R^6$ is alkylene containing 1 to 12 carbon atoms, or phenylene, $R^5$ and $R^4$ are individually selected from the group consisting of hydrogen, alkyl; or taken together represent alkylene containing 2 or 3 carbon atoms; and m is 1 to 4 and w is 1 or 2; and wherein A' is an alpha-sulfonylacetate or a 2-carboxycarboxamide.

4. A heat developable, photographic element as in claim 1 wherein said developing agent consists essentially of a 3-pyrazolidone developing agent.

5. A heat developable, photographic element as in claim 1 wherein said developing agent comprises a combination of a hydroquinone developing agent with an ascorbic acid developing agent.

6. A heat developable, photographic element as in claim 1 wherein said activator precursor is also an image stabilizer precursor.

7. A heat developable, photographic element as in claim 1 wherein said activator precursor consists essentially of a 2-carboxycarboxamide.

8. A heat developable, photographic element as in claim 1 wherein said activator is a compound selected from the group consisting of bis(2-amino-2-thiazoline) methylene(sulfonylacetate), N-(2-thiazolino)-N'-(imidazolino) propanediamine ethylenebis(sulfonylacetate), 1,3-bis[2S-(N,N'-ethyleneisothiourea)ethyl]urea ethylenebis(sulfonylacetate), and 1,3-bis(2-amino-2-thiazolinyl)propane.N,N'-ethylenebis(phthalamic acid), and combinations thereof.

9. A heat developable, photographic element for providing a dye enhanced, silver image comprising a support having thereon:

(A) at least one heat developable photographic layer comprising
  (i) photosensitive silver halide,
  (ii) a 3-pyrazolidone silver halide developing agent,
  (iii) an activating concentration of an activator precursor consisting essentially of 1,3-bis(2-amino-2-thiazolinyl)propane.N,N'-ethylenebis(phthalamic acid), and
  (iv) a polymeric binder, and, contiguous to this layer (A), (B) at least one layer comprising an azoaniline dye that upon development of a latent image in said layer (A) by uniformly heating is bleached in the non-image areas of said element.

10. A heat developable, photographic element for providing a dye enhanced, silver image comprising a support having thereon:

(A) at least one heat developable photographic layer comprising per $dm^2$ of support
  (i) $10^{-4}$ to $10^{-5}$ moles of photosensitive silver halide,
  (ii) $10^{-4}$ to $10^{-6}$ moles of at least one active silver halide developing agent,
  (iii) $5\times10^{-4}$ to $2\times10^{-5}$ moles of an activator precursor, and
  (iv) a gelatino binder, and, contiguous to this layer (A), (B) at least one layer comprising $10^{-5}$ to $10^{-6}$ moles of at least one azoaniline dye represented by the formula:

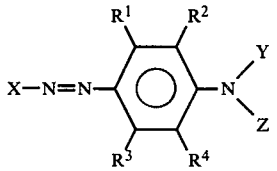

wherein X is a benzene, thiophene, pyrrole, thiazole or furan ring having at least one electron withdrawing functional group that is a nitro, halo, trifluoromethyl, acetyl, cyano or methylsulfonyl group, selected to provide a sum of Hammett substituent constants that is greater than +0.7; $R^1$, $R^2$, $R^3$ and $R^4$ are individually selected from hydrogen, alkyl containing 1 to 12 carbon atoms, alkoxy containing 1 to 12 carbon atoms, acyl containing 1 to 12 carbon atoms, and amido containing 1 to 12 carbon atoms; Y and Z are individually selected from hydrogen, alkyl containing 1 to 12 carbon atoms and cycloalkyl containing 5 to 7 carbon atoms.

11. A heat developable, photographic element for providing a dye enhanced, silver image comprising a support having thereon:

(A) at least one heat developable photographic layer comprising
  (i) photosensitive silver halide,
  (ii) 4-methyl-4-hydroxymethyl-1-phenyl-3-pyrazolidone,
  (iii) an activating concentration of an activator precursor consisting essentially of 1,3-bis(2-amino-2-thiazolinyl)propane.N,N'-ethylene bis(phthalamic acid),
  (iv) a gelatino binder, and, contiguous to this layer (A), (B) at least one layer comprising an azoaniline dye represented by the formula:

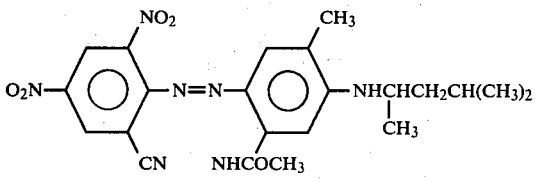

12. A heat developable, photographic element for providing a dye enhanced, silver image comprising a support having thereon:

(A) at least one heat developable layer comprising
  (i) photosensitive silver halide,
  (ii) at least one active silver halide developing agent,
  (iii) an activating concentration of a development activator precursor, and
  (iv) a polymeric binder, and, contiguous to this layer (A), (B) at least one layer comprising an azoaniline dye that upon development of a latent image in said layer (A) by uniformly heating is bleached in the non-image areas of said element, wherein said azoaniline dye is represented by the formula:

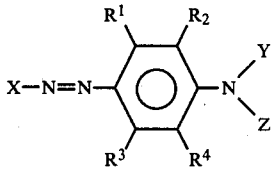

wherein X is a benzene, thiophene, pyrrole, thiazole or furan ring having at least one electron withdrawing functional group that is a nitro, halo, trifluoromethyl, acetyl, cyano or methylsulfonyl group, selected to provide a sum of Hammett substituent constants that is greater than +0.7; $R^1$, $R^2$, $R^3$ and $R^4$ are individually selected from hydrogen, alkyl containing 1 to 12 carbon atoms, alkoxy containing 1 to 12 carbon atoms, acyl containing 1 to 12 carbon atoms, and amido containing 1 to 12 carbon atoms; Y and Z are individually selected from hydrogen, alkyl containing 1 to 12 carbon atoms and cycloalkyl containing 5 to 7 carbon atoms.

13. A process of providing a dye enhanced, silver image in an exposed heat developable, photographic element comprising a support having thereon:

(A) at least one heat developable layer comprising
  (i) photosensitive silver halide,
  (ii) at least one active silver halide developing agent,
  (iii) an activating concentration of a development activator precursor, and (iv) a polymeric binder, and, contiguous to this layer (A), (B) at least one layer comprising an azoaniline dye that upon development of a latent image in said layer (A) by uniformly heating is bleached in the non-image areas of said element;

comprising heating said element to a temperature within the range of about 115° C. to about 180° C. until an image is developed.

14. A process of providing a dye enhanced silver image in an exposed heat developable, photographic element as in claim 13 wherein said element is heated to a temperature with the range of about 115° C. to about 180° C. for 5 to 60 seconds.

15. A process of providing a dye enhanced, silver image in an exposed heat developable, photographic element comprising a support having thereon:

(A) at least one heat developable, photographic layer comprising (i) photosensitive silver halide, (ii) at least one active silver halide developing agent, (iii) an activating concentration of a development activator precursor, and (iv) a gelatino binder, and, contiguous to this layer (A), (B) at least one layer comprising at least one azoaniline dye selected from the group consisting of

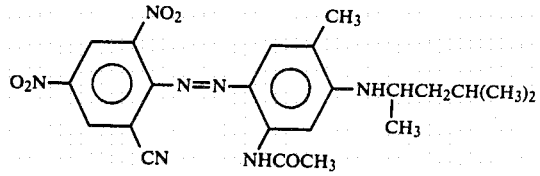

and

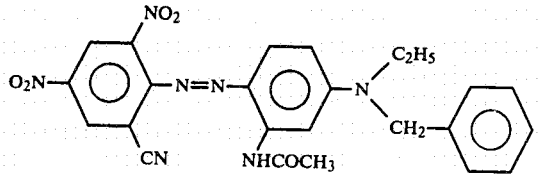

and combination thereof;

comprising heating said element to a temperature within the range of about 115° C. to about 180° C. until an image is developed.

* * * * *